US011396690B2

(12) United States Patent
Djavanroodi

(10) Patent No.: US 11,396,690 B2
(45) **Date of Patent: *Jul. 26, 2022**

(54) METHOD OF PRODUCING MEDICALLY APPLICABLE TITANIUM

(71) Applicant: Prince Mohammad Bin Fahd University, Dhahran (SA)

(72) Inventor: Faramarz Djavanroodi, London (GB)

(73) Assignee: Prince Mohammad Bin Fahd University, Dhahran (SA)

( * ) Notice: Subject to any disclaimer, the term of this patent is extended or adjusted under 35 U.S.C. 154(b) by 316 days.

This patent is subject to a terminal disclaimer.

(21) Appl. No.: 16/742,417

(22) Filed: Jan. 14, 2020

(65) Prior Publication Data

US 2021/0214829 A1 Jul. 15, 2021

(51) Int. Cl.
*C22F 1/18* (2006.01)

(52) U.S. Cl.
CPC ..... *C22F 1/183* (2013.01)

(58) Field of Classification Search
CPC ..... C22F 1/183; C21D 7/06; B24C 1/10
See application file for complete search history.

(56) References Cited

U.S. PATENT DOCUMENTS 6,399,215 B1 * 6/2002 Zhu ..... A61L 27/06 623/924
2008/0276681 A1 * 11/2008 Han ..... C22F 1/08 72/271
2017/0121803 A1 5/2017 Zheng
2017/0355016 A1 12/2017 Roy et al.
2018/0304368 A1 * 10/2018 Roy ..... E21B 43/26

OTHER PUBLICATIONS

Attarilar et al., "Functionally graded titanium implants: Characteristic enhancement induced by combined severe plastic deformation, " PLOS ONE, Published Aug. 23, 2019, pp. 1-18 (Year: 2019).*
Ralston, et al. ; Effect of grain size on corrosion of high purity aluminium ; Electrochimica Acta, vol. 56, Issue 4 ; PP1729-1736 ; Jan. 15, 2011 ; Abstract Only ; 2 Pages.
Tao, et al. ; Preparation Techniques for Nano-Structured Metallic Materials via Plastic Deformation ; Acta Metall Sin, 2014, 50(2) ; pp. 141-147 ; 3 Pages.
Yao, et al. ; An Evaluation of a Bonded Layer Formed on Ti—6Al—4V Alloy by Means of SMAT and Low-Temperature Bonding ; Materials 9 ; 2016 ; 10 Pages.

* cited by examiner

*Primary Examiner* — John A Hevey
(74) *Attorney, Agent, or Firm* — Oblon, McClelland, Maier & Neustadt, L.L.P.

(57) ABSTRACT

A method of producing medically applicable nanostructured titanium with improved mechanical properties includes performing an equal-channel angular pressing (ECAP) and subsequently performing a surface mechanical attrition treatment (SMAT). By performing the ECAP processing on a titanium sample, an ultrafine grained structure is obtained. The ultrafine grained structure may improve the biocompatibility and mechanical properties of pure titanium. When the SMAT processing is performed on the ultrafine grained structure, a nanostructured surface may be obtained. The SMAT processing may be used to enhance the strength of pure titanium to be used in medically applicable implants.

14 Claims, 5 Drawing Sheets

ECAP

SMAT

METHOD OF PRODUCING MEDICALLY APPLICABLE TITANIUM

CROSS REFERENCE TO RELATED APPLICATIONS

The present application is related to the patent application titled "METHOD FOR PRODUCING HIGH STRENGTH TITANIUM PIPE" Ser. No. 16/738,244, which has an inventor in common with the present application and is incorporated herein by reference in its entirety.

PRIOR DISCLOSURE BY AN INVENTOR

Aspects of the present application are described in "Functionally graded titanium implants: Characteristic enhancement induced by combined severe plastic deformation," PLOS ONE, https://doi.org/10.1371/journal.pone.0221491 (Aug. 23, 2019) which is incorporated herein by reference in its entirety.

BACKGROUND

Field of the Invention

The present disclosure relates to an equal-channel angular pressing (ECAP) processing method and a surface mechanical attrition treatment (SMAT) method to produce functionally graded titanium for use in, for example, medical devices and implants.

Description of the Related Art

Titanium (Ti) is a biometal which is widely used in dental implants and orthopedic prosthesis due to favorable corrosion resistance, biocompatibility, and usage as a replacement for hard tissue. Titanium is usually alloyed in order to improve its mechanical properties. When alloyed as Ti-6Al-4V, the release of aluminum and vanadium may have adverse health effects on a patient and adverse mechanical effects on the titanium. In particular, the release of aluminum and vanadium may lead to cytotoxicity and influence cellular behavior such as osteoblast metabolism. The release of aluminum and vanadium can also lead to nuclear DNA damages. Therefore, using alloyed titanium may not be ideal to obtain mechanical improvements of biomaterials.

Equal-channel angular pressing (ECAP) has been used to improve the biocompatibility and mechanical properties of pure titanium. The main purpose of using ECAP is to subject a bulk titanium material to a high amount of plastic strains, wherein the plastic strain is applied through a combination of compressive and shear stresses without causing dimensional changes to the titanium sample. The process typically requires an increase in free energy of the polycrystalline material which usually generates additional crystal defects and grain boundaries. By repeatedly subjecting the titanium sample to plastic strain, an ultrafine grained (UFG) structure may be obtained and even a nanostructured (NS) material having superior mechanical properties may be obtained. The grain refinement obtained through the ECAP is known to enhance the mechanical strength and biocompatibility of titanium implants.

In addition to the bulk attributes such as corrosion resistance and biocompatibility, the surface properties of titanium are also vital in cell-substrate interactions. Therefore, modifications of topography, roughness, and wettability along with other comparable surface parameters are of significant importance. Bioinspired nanostructured materials with a surface structure less than 100 nanometers (nm), can be essential in solving issues associated with existing titanium based implants. Nanostructuring can be performed using the surface mechanical attrition treatment (SMAT) processing method to design implants, especially implants that are used for orthopedic and cardiovascular applications.

In view of the drawbacks of existing titanium materials, especially when used as medical implants, one objective of the present disclosure is to describe a method of producing micromechanically graded material with superior mechanical properties that is suitable for medical applications. In doing so, the present disclosure describes a method of applying ECAP to a titanium sample and subsequently SMAT processing a surface of the titanium sample previously subjected to ECAP processing, such that the combination of the ECAP processing and the SMAT processing forms nanostructured regions in the titanium sample. The method described by the present disclosure can be performed within a limited time period, is cost effective, simple in structure, environmentally friendly, and practical when compared to conventional methods used to develop nanostructured surface regions.

SUMMARY OF THE INVENTION

The present disclosure describes a method of producing functionally graded titanium by initially performing an equal-channel angular pressing (ECAP) processing method, and subsequently performing a surface mechanical attrition treatment (SMAT) processing method to produce titanium that may be used for medically applicable implants. In particular, the ECAP processing method develops ultrafine grains in a commercially pure titanium sample that may improve titanium biocompatibility and enhance mechanical properties. The SMAT processing method develops a nanostructured region that may improve roughness, wettability and hardness of the commercially pure titanium sample.

An ECAP die and a sample-passing channel are used to perform the ECAP processing method. The sample-passing channel is integrated within a block of the ECAP die. The commercially pure titanium sample is moved through the sample-passing channel such that compressive and shear forces are applied on the titanium sample to develop an ultrafine grained structure. On the other hand, a chamber, a plurality of spherical balls, and a vibration generator are used to perform the SMAT processing method. The vibration generator moves the plurality of spherical balls positioned within the chamber to strike a surface of the titanium sample. The striking produces a nanostructured region in the titanium sample.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

All illustrations of the drawings are for the purpose of describing selected embodiments of the present disclosure and are not intended to limit the scope of the present disclosure or accompanying claims.

The present disclosure describes a method of producing functionally graded titanium using a combination of an equal-channel angular pressing (ECAP) and surface mechanical attrition treatment (SMAT), wherein the produced titanium may be used for medically applicable implants, for example. More specifically, the ECAP processing may improve the biocompatibility and mechanical properties of a titanium sample, preferably commercially pure. On the other hand, the SMAT may improve a roughness, a wettability, and/or a hardness of the titanium sample.

Figure 1:
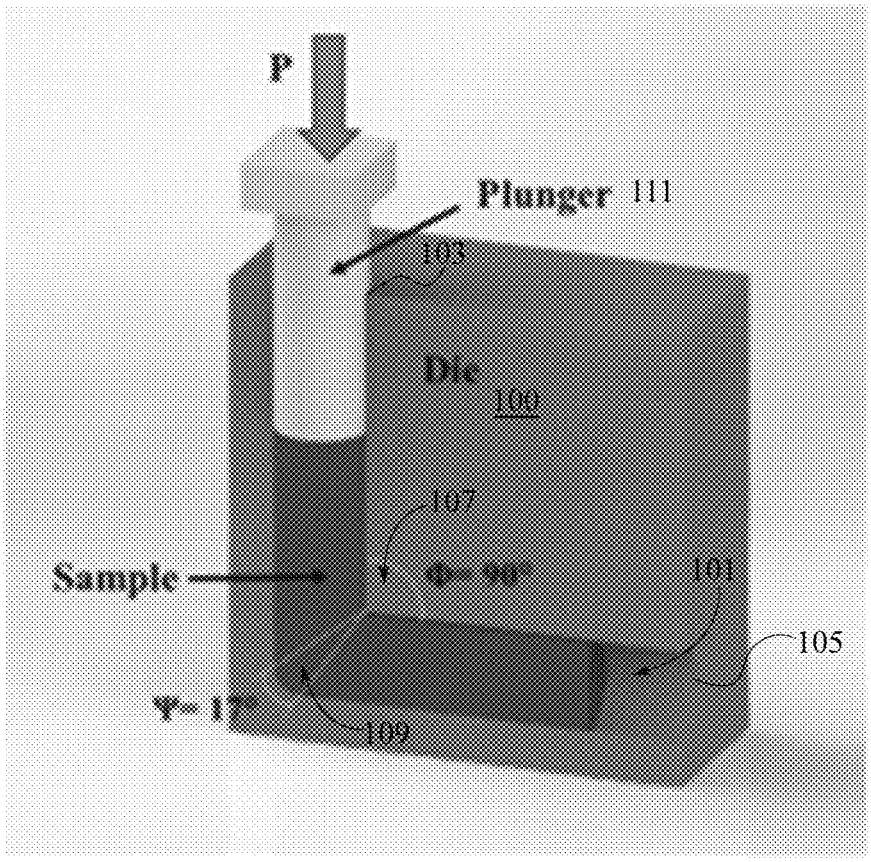
FIG. 1 is an illustration of a system used to perform equal-channel angular pressing (ECAP) on a titanium sample.

As illustrated in FIG. 1, the method of the present disclosure includes ECAP processing a titanium sample. When the ECAP processing is performed, the titanium sample is subjected to high plastic deformation with no change to the cross-sectional area of the titanium sample. Plastic deformation is achieved by a combination of compressive and shear stresses on the titanium sample. The plastic strain results in an ultrafine grained structure in the titanium sample. As a result, the strength, hardness, and toughness of the titanium sample is improved. In a preferred embodiment, after 4 or more passes of ECAP processing, the titanium sample may have an average grain size within a range of 400 nanometers (nm)-600 nm, preferably 450 nm-550 nm with a preferred average grain size of about 500 nm. Microstructural examination may be used to confirm the ultrafine grained structure after the ECAP processing method is performed.

Preferably, electron backscatter diffraction (EBSD) is used as the microstructural examination method. EBSD is a scanning electron microscope-based microstructural-crystallographic characterization technique commonly used in the study of crystalline or polycrystalline materials. The technique can provide information about the structure, crystal orientation, phase, or strain in the material. Traditionally these types of studies have been carried out using X-ray diffraction (XRD), neutron diffraction and/or electron diffraction in a transmission electron microscope (TEM).

Experimentally EBSD is conducted using a scanning electron microscope (SEM) equipped with an EBSD detector containing at least a phosphor screen, compact lens and low light Charged Coupled Device (CCD) camera. Commercially available EBSD systems typically come with one of two different CCD cameras: for fast measurements the CCD chip has a native resolution of 640×480 pixels; for slower, and more sensitive measurements, the CCD chip resolution can go up to 1600×1200 pixels. The biggest advantage of the high-resolution detectors is their higher sensitivity, and therefore the information within each diffraction pattern can be analyzed in more detail. For texture and orientation measurements, the diffraction patterns are binned in order to reduce their size and reduce computational times. Modern CCD-based EBSD systems can index patterns at up to 1800 patterns/second. This enables very rapid and rich microstructural maps to be generated. Recently, complementary metal-oxide-semiconductor (CMOS) detectors have also been used in the design of EBSD systems. The new CMOS-based systems permit pattern indexing faster than CCD-based predecessors. Modern CMOS-based EBSD detectors are capable of indexing patterns up to 3000 patterns/second.

EBSD is amongst the fastest and most reliable methods to acquire data for crystalline structure and orientation in a solid crystalline phase. Unlike optical techniques, it is possible to acquire data for phases of all symmetries (even isotropic phases) and for opaque phases. The data gives true 3-dimensional orientations for individual crystals, which is superior to optical pole figures which give 2-dimensional orientations. The spatial resolution can be on the order of several microns, which is much superior to resolution attainable using selected area channeling (SAC) techniques. EBSD data acquired using either a scanned electron beam, or an automated stage and a stationary electron beam can include analyses of thousands of individual grains in a run accomplished in hours; acquisition of data for 10's of thousands of individual spots in a single one-day run is routine in most laboratories. TEM can yield excellent diffraction data with exceptionally high spatial resolution for individual crystals, but sample preparation is considerably more involved than it is for EBSD studies, and most TEM mounts can only be examined over an area that is relatively small compared with areas accessible using EBSD.

After ECAP processing, the method of the present disclosure includes SMAT processing a surface of the ultrafine grained structure obtained from the ECAPed titanium sample.

Figure 2:
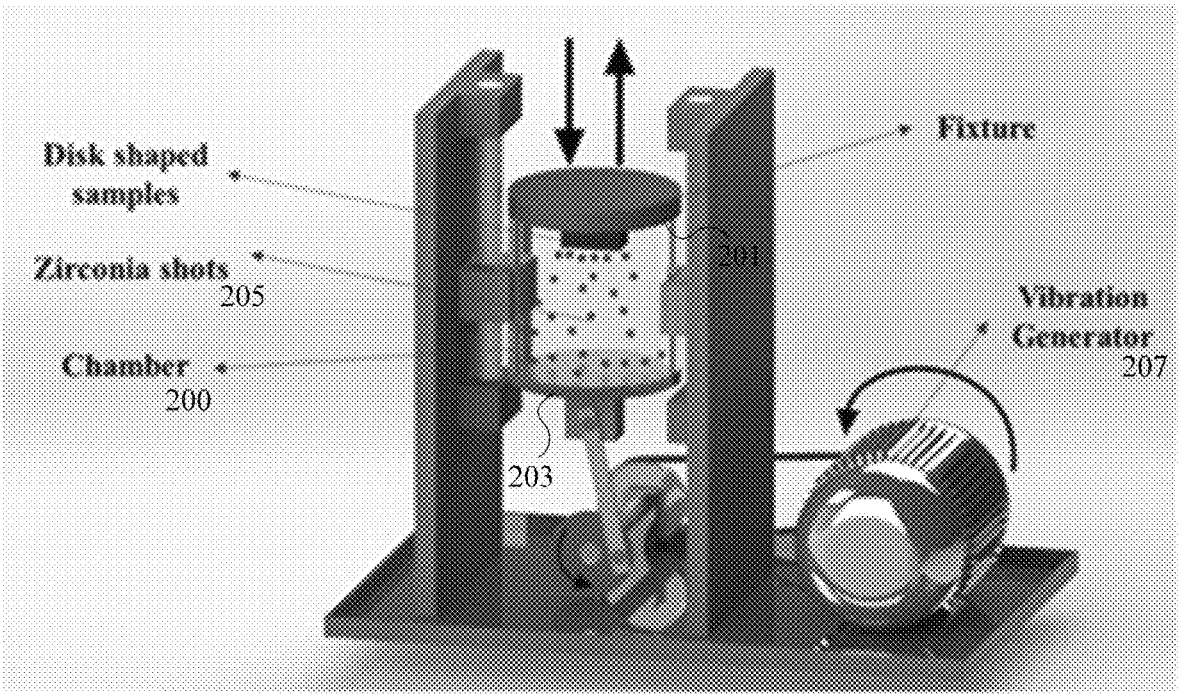
FIG. 2 is an illustration of a system used to perform surface mechanical attrition treatment (SMAT) on a titanium sample on which ECAP processing was performed.

An embodiment of a system used to perform SMAT processing is shown in FIG. 2. As a consequence of the SMAT processing the nanostructured surface shows enhancements in hardness, roughness, and wettability, wherein wettability is the ability of a liquid to maintain contact with a solid surface.

Preferably the SMAT device used for SMAT processing includes a stainless-steel chamber (e.g., for smaller samples, having a size of about 90 mm height and about 80 mm diameter) that moves in a reciprocating motion as driven by an electrical motor. Through this type of movement hard beads (shots) are directly impacted on the exposed surface of the sample in a random manner. Preferably, the hard beads are ceramic zirconia with a 5 mm diameter, 700 Hv, 3.85 g/cm$^3$ specific gravity, and composition of 60-70% $ZrO_2$, 28-33% $SiO_2$ and $Al_2O_3$<10% were used in order to prevent the entry of toxic elements to the sample surface which may occur with conventional steel beads. Zirconia beads have a chemically inactive nature, white color, and very smooth surface and a hundred of these ceramic zirconia shots were placed in the chamber. The time taken to produce SMAT disks were 2 hours.

Nano indentation tests may be conducted to measure the hardness. Nanoindenting is a method to characterize material mechanical properties on a very small scale. Features less than 100 nm across, as well as thin films less than 5 nm thick, can be evaluated. Test methods include indentation for comparative and quantitative hardness determination and scratching for evaluation of wear resistance and thin film adhesion. Nanoindenting is performed in conjunction with atomic force microscopy (AFM). The area for testing is located by AFM imaging, and indentations and scratching marks are imaged by AFM after testing. A three-sided, pyramid-shaped diamond probe tip is typically used to indent, scratch and image the sample.

For indentation, the probe is forced into the surface at a selected rate and to a selected maximum force. In scratching, the probe is dragged across the sample surface. The force, rate, length and angle of the scratch is controlled. Imaging is performed in situ using the probe in intermittent contact (tapping mode) AFM. The depth of the indentation is measured from the AFM image to evaluate hardness. A force-displacement curve obtained during indentation also provides indications of the sample material's mechanical and physical properties.

Atomic force microscopy (AFM) may be used to deliver 3-dimensional images on surface topographies, providing information about properties such as roughness or stiffness. AFM measures ultrasmall forces (less than 1 nanonewton (nN)) present between the AFM tip surface and a sample surface. These small forces are measured by measuring the motion of a very flexible cantilever beam having an ultrasmall mass. In the operation of high-resolution AFM, the sample is generally scanned instead of the tip as in scanning tunneling microscopy (STM), because AFM measures the relative displacement between the cantilever surface and reference surface, and any cantilever movement would add vibrations. However, AFMs are now available where the tip is scanned and the sample is stationary. As long as the AFM is operated in the so-called contact mode, little if any vibration is introduced.

In other embodiments, different roughness measuring instruments may be used. For example, a mechanical stylus method may be used in one embodiment. This method includes an instrument that amplifies and records the vertical motion of a stylus at a constant speed from the surface that is being measured. The stylus arm is coupled to the core of a linear variable differential transformer (LVDT) to monitor vertical motions. The core of a force solenoid is coupled to the stylus arm and its coil is energized to load the stylus tip against the sample. A proximity probe (photo optical sensor) is used to provide a soft limit to the vertical location of the stylus with respect to the sample. The sample is scanned under the stylus at a constant speed.

In a different embodiment, optical methods may be used to measure the roughness. When a light wave is incident on a surface, the light wave is reflected either specularly and/or diffusively. Reflection is totally specular when the angle of reflection is equal to the angle of incidence, and is generally true for smooth surfaces. Reflection is totally diffused or scattered when the energy in the incident beam is distributed as the cosine of the angle of reflection according to Lambert's law. In particular, Lambert's law states that the reflected energy from a small surface area in a particular direction is proportional to cosine of the angle between that direction and the surface normal. Lambert's law determines how much of the incoming light energy is reflected. As roughness increases, the intensity of the specular beam decreases while the diffracted radiation increases in intensity and becomes more diffuse. In most real surfaces, reflections are neither completely specular nor completely diffuse. Clearly, the relationships between the wavelength of radiation and the surface roughness will affect the physics of reflection; thus, a surface that is smooth to radiation of one wavelength may behave as if it were rough to radiation of a different wavelength.

Wetting is the ability of liquids to keep in contact with solid surfaces, wherein the ability is a direct result of intermolecular interactions, which occur when two media (liquid and solid) are brought together. Wettability studies usually involve the measurements of contact angle (CA), which indicates the degree of wetting when a solid and liquid interact. A low CA (<90°) corresponds to high wettability, and the fluid will spread over a large area of the surface. A high CA (>90°) corresponds to low wettability, and the fluid will minimize contact with the surface and form a compact liquid droplet. CA>150° indicates minimal contact between the liquid droplet and the surface and corresponds to a superhydrophobic behavior.

Immediately after an implant is introduced inside the human body, the first events that occur are the wetting of the material by the physiological fluids, followed by attachment of cells to the implant surface. In order to evaluate the wetting behavior of a system, quantitative (CA, imbibition, and forced displacement, and electrical resistivity wettability) and qualitative (imbibition rates, microscope examination, flotation, glass slide, relative permeability curves, permeability/saturation relationships, capillary pressure curves, capillarimetric method, displacement capillary pressure, reservoir logs, nuclear magnetic resonance, and dye adsorption) methods have been developed. Among these, CA measurement is probably the most adopted technique to investigate the average wettability of a surface. Moreover, this type of investigation has been extensively applied to assess the wetting behavior of different nanostructured surfaces, used for various medical applications.

CA can be classified into static or dynamic. Static CA is measured when liquid droplet is standing alone on the surface, without needle insertion, and the solid/liquid/air boundary is not moving. These measurements are used in quality control and research and product development. One can measure the dynamic CA when the solid/liquid/air boundary is moving. In this way, advancing and receding CA are measured. CA hysteresis, which represents the difference between these two angles, comes from surface chemical and topographical heterogeneities, solution impurities absorbing on the surface, or swelling, rearrangement or alteration of the surface by the solvent.

Figure 3:
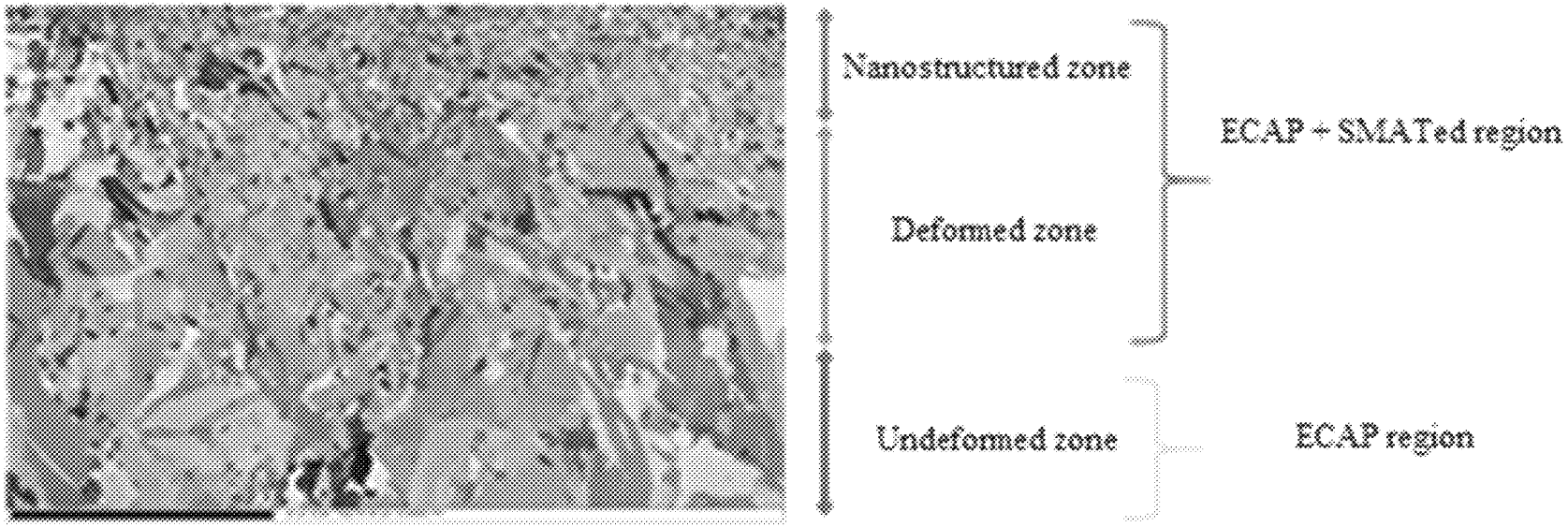
FIG. 3 is a result obtained from electron backscatter diffraction (EBSD) to determine the grain boundary after ECAP processing and SMAT processing, wherein the different structural regions in the depth of the commercially pure titanium sample are shown.

In a preferred embodiment, as shown in FIG. 3, after SMAT processing, the nanostructured region extends to a depth of from 100 micrometers (μm) to 125 μm, preferably 105 μm-115 μm with a preferable depth of about 112 μm from the surface of the ultrafine grained structure.

In a preferred embodiment, after both the ECAP processing and the SMAT processing, a cell viability of the titanium sample may improve by a value which can be within a range of 5%-10%, preferably 6%-9% with a preferable improvement of about 7%. Cell viability, defined as the number of healthy cells in a sample, determines the amount of cells (regardless of phase around the cell cycle) that are living or dead, based on a total cell sample. While a basic cell count is a direct measure of proliferation and viability, measurements of DNA content or metabolic activity can offer more information about the physical condition and cell cycle stage. To examine the biological response of the titanium sample after ECAP processing and SMAT processing, human osteosarcoma cells may be cultured in contact with the titanium sample.

In order to determine the biological response, cells may be cultured for 1, 3, and 8 days and 1 day for the adhesion test. The conventional 96-well culture plates (n=3 for each set) may be used. The cell densities on the titanium samples may be analyzed via an ultraviolet (UV) spectrometer by a viable color change in the cells. The color absorbance was measured at approximately 500 nm wavelength using microplate reader ELx808 Bio-Tek. In addition, cells may be cultured on the titanium samples for 1, 3 and 5 days and alkaline phosphatase (ALP) activity was measured in 2-amino-2-methyl-1-propanol buffer, pH 10.3, at 37° C. with p-nitrophenyl phosphate as the substrate. Enzyme activity was read at 405 nm by a microplate reader. The ALP activity was reported in terms of micromoles per minute per milligram protein. In order to assay the morphological characteristics, cells were grown on the samples for 1 day and subsequently were washed with phosphate-buffered saline (PBS) and then fixed by 2.5% glutaraldehyde and dehydrated in ethanol-water baths graded series to 100% and finally they were studied through the SEM device.

Additionally, improved cell differentiation and mineralization may also be observed when titanium samples that underwent both ECAP and the SMAT are used in implants. In particular, as a result of grain refinement which influences cellular activity and biomineralization, the nanostructured titanium sample may show improved results for ALP activity. Microstructural examination may be used to confirm the nanostructured surface after the SMAT processing method. Furthermore, the grain refinement through the combined application of ECAP and SMAT is favorable for the biological response of materials, since the grain refinement can provoke various bone type cells and lead to better proliferation and adhesion, wherein cell proliferation is the process that results in an increase of the number of cells, and is defined by the balance between cell divisions and cell loss through cell death or differentiation. Cell adhesion is the process by which cells form contacts with each other or with their substratum through specialized protein complexes. Intercellular adhesion can be mediated by adherens junctions, tight junctions and desmosomes, whereas cells can interact with extracellular matrix molecules through focal adhesions. An adherens junction is defined as a cell junction whose cytoplasmic face is linked to the actin cytoskeleton. Tight junctions act as barriers that regulate the movement of water and solutes between epithelial layers, wherein an epithelial layer refers to a thin tissue forming an outer layer of a surface of the body. Tight junctions are classified as a paracellular barrier type which is defined as not having directional discrimination; however, movement of the solute is largely dependent upon size and charge. Desmosomes are intercellular junctions that provide strong adhesion between cells. Desmosomes resist mechanical stress because they adopt a strongly adhesive state in which they are said to be hyper-adhesive and which distinguishes them from other intercellular junctions; desmosomes are specialized for strong adhesion and their failure can result in diseases of the skin and heart.

Additionally, cell viability and alkaline phosphate activity can be conducted to monitor cell morphology. The combined use of the ECAP processing method and the SMAT processing method may be used to improve the design of modern functionally graded titanium used in medical devices and implants.

Figure 5:
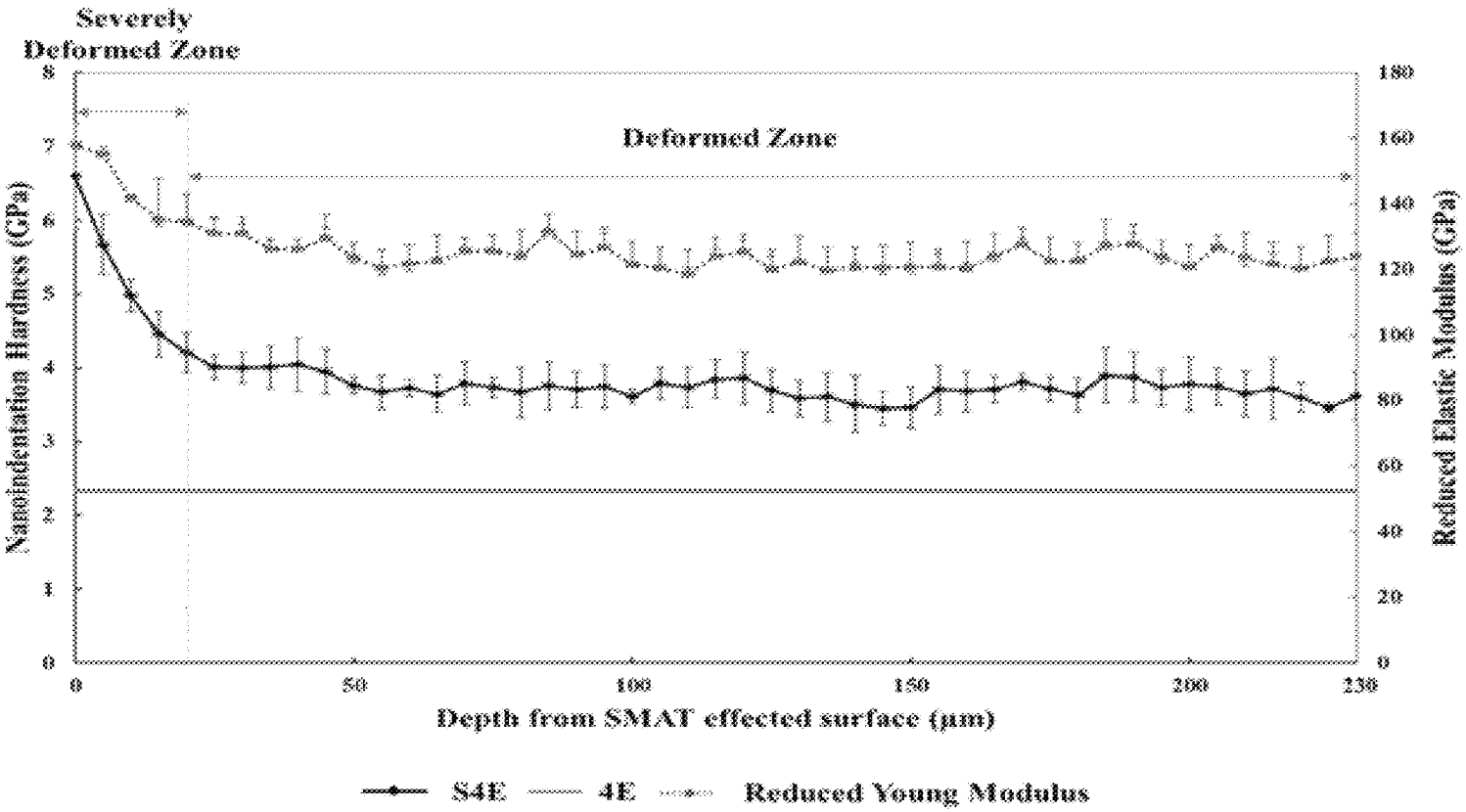
FIG. 5 shows the through-thickness profiles of nanoindentation hardness and reduced Young modulus (Er) for S4E (4 pass ECAP+SMAT) and 4E (4 pass ECAP) samples.

FIG. 5 represents the through-thickness profiles of nanoindentation hardness and reduced Young modulus (Er) for S4E (4 pass ECAP+SMAT) and 4E (4 pass ECAP) samples plotted to a depth of 230 μm from the surface. In the S4E sample, the severely deformed area has a thickness of approximately 20 μm and an average hardness of 5.18 GPa (528 Hv), about 75.6% greater than the 4E sample. In the S4E sample the average hardness of the deformed zone up to 230 μm is about 3.72 GPa (379.3 Hv) representing an about 45% improvement compared to 4E sample. In addition, the reduced modulus of 4E sample has a similar trend and decreases as a function of depth from SMAT treated surface. The maximum value in the topmost surface is 158 GPa about 27% enhancement and then gradually decreases.

In embodiments of the invention the SMAT processing is carried out with zirconia beads having a diameter of from 1-10 mm, preferably 2-8 mm or about 5 mm. The sample is preferably enclosed in a chamber such that zirconia beads can be recycled and reused in a process similar to sandblasting. More preferably, zirconia beads are mechanically manipulated to increase their kinetic energy through the use of, for example, a piston or floor plate which impacts the beads onto the sample surface. The bead density per cubic centimeter is from about 0.5-100 beads/$cm^3$, preferably 1-50 beads/$cm^3$, 5-40 beads/$cm^3$, or 10-25 beads/$cm^3$.

SMAT processing is carried out for a time sufficient to impart a modified surface to an ECAPed sample. The surface is preferably modified to a depth of 10-500μ, preferably 20-300μ, preferably 50-200μ or about 100μ. Not including a severely the form zone which may extend to a depth of 10-100μ, preferably about 50μ or about 20μ, the deformed SMAT-treated zone has a substantially different properties with respect to at least nano indentation hardness and elastic modulus. Preferably, SMAT process is carried out to provide a nano indentation hardness improvement of 10-100%, preferably 20-80%, 30-70%, 40-60% in comparison to the ECAPed only predecessor material. Nano indentation hardness of the SMAT-processed materials are preferably in the range of 5-10 GPa, 6-8 GPa, 7-8 GPa or about 6 GPa in a deformed zone which may extend, for example, from about 20 to about 1,000μ (or sample thickness), preferably 5-500μ, 50-500μ, or 100-200μ.

ECAP processing applied severe plastic deformation to the titanium material, and thereby subjects the titanium to high plastic deformation without changing its original cross-sectional area.

As seen in FIG. 1, a system used to perform ECAP processing comprises an ECAP die 100 and a sample-passing channel 101. The ECAP die 100 is used to maintain a cross-sectional area of the titanium sample as it undergoes plastic strain. The ECAP die 100 has high resistance to wear, plastic deformation, and fatigue. The ECAP die 100 can vary in different embodiments of the method described in the present disclosure. The material suitable for ECAP dies are mostly hard steels (termed "die steels") such as H13 tool steel, chromium 12 series cold-forming die steel and M2 high-speed steel, PGI Supports Tool & Die Shops (without limitation) provides customized dies made of A2, D2, S7, H13 tool steels. The exact choice of die steel relies on the management of temperature regime during the extrusion process, which in turn depends on the intensity of heat removal and the choice of a cooling system (water, oil, air, convective, evaporative without limiting).

In one embodiment, 34CrNiMo6 steel alloy may be used as the ECAP die 100. To enhance the resistance to wear and plastic deformation, 34CrNiMo6 steel alloy may be subjected to a heat treatment cycle prior to use. In the heat treatment cycle, 34CrNiMo6 steel alloy is surface hardened at 850° C., followed by oil quenching, and then tempered at 600° C. with subsequent air cooling to provide sufficient toughness.

Case-hardening or surface hardening is a process of hardening the surface of a metal object while allowing the metal underneath the surface to remain soft, thus forming a thin layer of harder metal, referred to as the case, at the surface. For iron or steel with low carbon content, which has poor to no hardenability of its own, the case-hardening process involves infusing additional carbon or nitrogen into the surface layer. Case-hardening is usually done after the part has been formed into a required final shape, but can also be done to increase the hardening element content of bars used in a pattern welding or similar processes.

Quenching is the rapid cooling of a workpiece in water, oil or air to obtain certain material properties. A type of heat treating, quenching prevents undesired low-temperature processes, such as phase transformations, from occurring. The undesired low-temperature processes are prevented by reducing the window of time during which these undesired reactions are both thermodynamically favorable, and kinetically accessible; for instance, quenching can reduce the crystal grain size of both metallic and plastic materials, increasing their hardness.

Tempering is a process of heat treating, which is used to increase the toughness of iron-based alloys. Tempering is usually performed after hardening, to reduce some of the excess hardness, and is done by heating the metal to some temperature below the critical point for a certain period of time, then allowing it to cool in still air. The exact temperature determines the amount of hardness removed, and depends on both the specific composition of the alloy and on the desired properties in the finished product.

The sample-passing channel 101 of the ECAP die 100 is used to guide the titanium sample through the ECAP die 100 while the sample is subjected to a combination of compressive and shear stresses. The sample-passing channel 101 is integrated into the ECAP die 100 such that the cross-sectional area of the titanium sample is maintained while the combination of compressive and shear forces is applied. In order to apply the combination of compressing and shear forces, the pure titanium sample is pushed into the sample-passing channel 101 at a first end 103 of the sample-passing channel 101 using a plunger 111, and pulled out of a second end 105 of the sample-passing channel 101.

In a preferred embodiment, the sample-passing channel 101 has an overall L-shape. More specifically, as seen in FIG. 1, the second end 105 is configured to be positioned at a channel angle 107 (Φ) and a curvature angle 109 (Ψ) with respect to the first end 103. The channel angle 107 and the curvature angle 109 are important in inducing strain in the pure titanium sample moving through the sample-passing channel 101. The channel angle 107 and the curvature angle 109 can vary in different embodiments. In a preferred embodiment, the channel angle 107 is within a range of 80 degrees (°)-120°, preferably 85°-110°, with a preferred channel angle 107 of about 90°. In a preferred embodiment, the curvature angle 109 is within a range of 15°-28°, preferably 15°-20°, with a preferred curvature angle 109 of about 17°. The effective strain induced on the titanium sample may decrease with an increase in the channel angle 107, the curvature angle 109, and friction. For example, if the channel angle 107 is increased from 90° to 140°, the effective strain may decrease by approximately 60%. Other critical parameters are back-pressure and friction, impacting temperature profile and plasticity of the metal.

If the friction for the pure titanium sample to move through the sample-passing channel 101 is increased from 0 to 0.3, the effective strain may decreased by approximately 10%. In order to reduce friction between the pure titanium sample and an inner surface of the sample-passing channel 101, the exterior surface of the titanium sample may be lubricated and the inner surface of the sample-passing channel 101 may be polished. In one embodiment, the pure titanium sample may be lubricated with graphite. For example, the outer surface of the titanium sample may be lubricated with a graphite-based lubricant Durcol W1040-02 supplied by The James Durrans Group. In another embodiment, the pure titanium sample may be lubricated with molybdenum disulfide ($MoS_2$).

$MoS_2$ is generally used as a lubricating material due to the layered structure and low coefficient of friction. The wear resistance of $MoS_2$ in lubricating applications may be increased by doping $MoS_2$ with chromium. Microindentation experiments on nanopillars of chromium doped $MoS_2$ found that the yield strength may increase from an average value within a range of 800 Megapascal (MPa)-825 MPa for pure $MoS_2$ to a value within a range of 1000 MPa-1050 MPa for chromium doped $MoS_2$, wherein nanopillars are pillar shaped nanostructures approximately 10 nanometers in diameter that can be grouped together in lattice like arrays.

In a different embodiment the titanium sample may be preheated before being inserted into the sample-passing channel 101. Preheating the pure titanium sample may enable easy deformation and reduce the force required from the plunger 111. Additionally, preheating of the pure titanium sample may reduce the probability of cracking. Preferably, the pure titanium sample is preheated to a temperature within a range 250 Centigrade (° C.)-350° C., preferably 275° C.-325° C., with a preferable temperature of about 320° C. In a different embodiment, the ECAP die 100 can be heated and the titanium sample may be heated from the ECAP die 100 during ECAPing. In such instances, a thermocouple may be used to control the temperature.

The plunger 111 used to move the titanium sample along the sample-passing channel 101 can vary in different embodiments. Preferably, the plunger 111 is manufactured from a material which can be, but is not limited to, H13 tool steel. Moreover, a cross-sectional shape is designed to match a cross-sectional shape of the pure titanium sample. In a preferred embodiment, a punch speed of the plunger 111 is within a range of 1 millimeters/second (mm/second)-4 mm/s, preferably 1 mm/s-3 mm/s with a preferable punch speed of about 2 mm/s. The load applied to press the titanium sample into the sample passing channel 101 can be varied, but is preferably 0.1-2.0 tons/$cm^2$, 0.5-1.5 tons/$cm^2$, about 1.0 tons/$cm^2$, or not greater than 1.5 tons/$cm^2$.

In one embodiment, the plunger 111 may be controlled by a servo-controlled hydraulic press, and the pure titanium sample can be inserted into the sample-passing channel 101 with a motor driven screw jack. In such instances, a punch from the hydraulic press will follow a sine waveform where a peak-to-peak amplitude is 2 mm.

As described earlier, with the ECAP processing, the cross-sectional area of the titanium sample remains unchanged. In order to maintain the cross-sectional area of the titanium sample, the titanium sample and the sample-passing channel 101 have a similar cross-sectional shape. Therefore, in one embodiment, a cross-sectional shape of the sample-passing channel 101 and a cross-sectional shape of the titanium sample can be square. In another embodiment, the cross-sectional shape of the sample-passing channel 101 and the cross-sectional shape of the titanium sample can be rectangular. In a different embodiment, the cross-sectional shape of the sample-passing channel 101 and the cross-sectional shape of the titanium sample can be circular. If the cross-sectional shape of the sample-passing channel 101 is circular, a diameter of the sample-passing channel 101 is can be within a range of 15 mm-25 mm, preferably 15 mm-20 mm, with a preferable diameter of approximately 19.8 mm. For the titanium sample to pass through the sample-passing channel 101, the titanium sample with a circular cross sectional shape may have a diameter which is approximately 19.7 mm. A length of the sample-passing channel 101 can vary. Preferably, the length of the sample-passing channel 101 can be within a range of 175 mm-225 mm, preferably 175 mm-200 mm, with a preferable length of about 180 mm.

Figure 4:
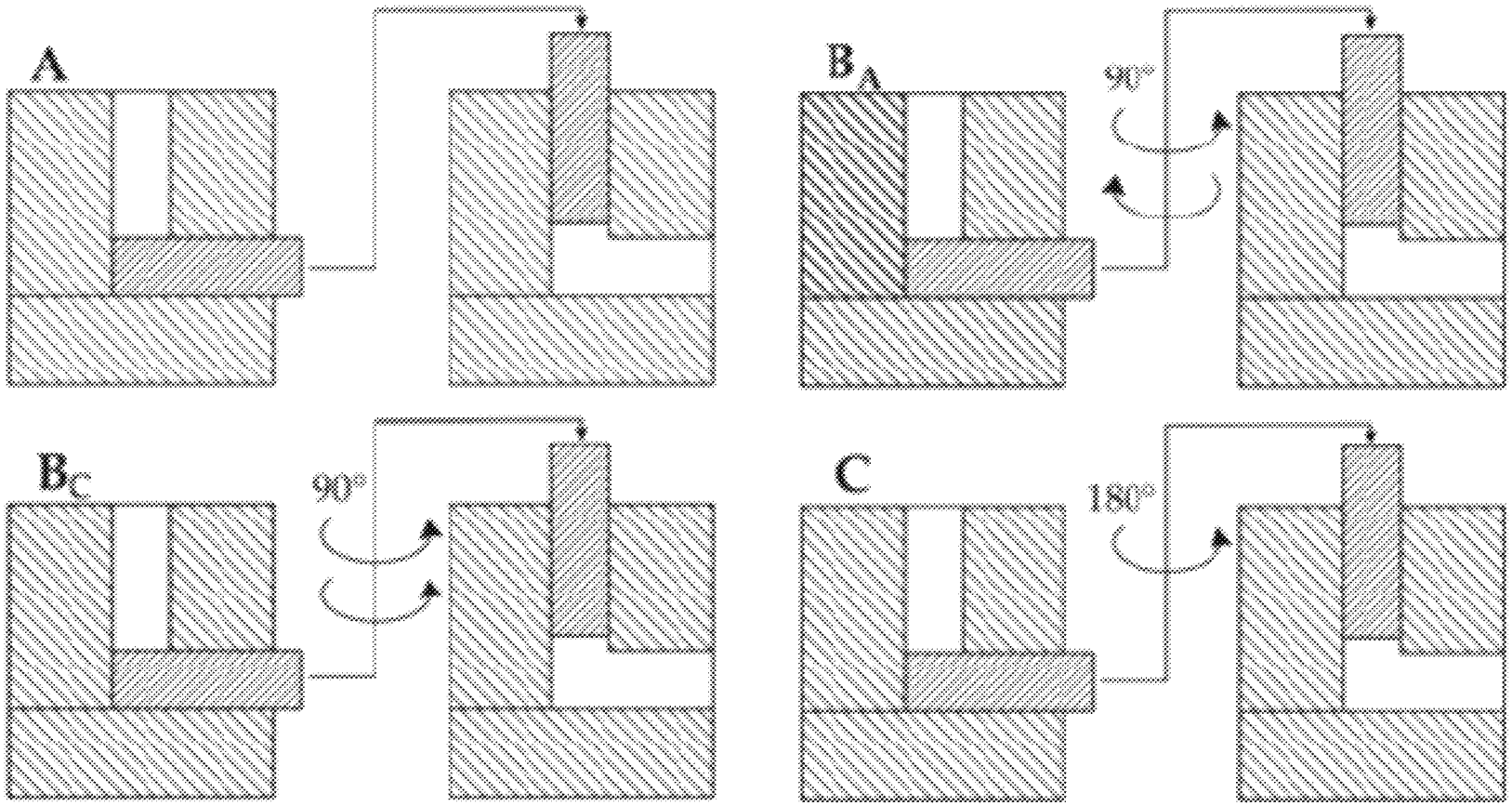
FIG. 4 is an illustration of the processing routes that can be followed during the ECAP processing method.

The sequence of orientations of a sample relative to the ECAP die 100 affects the microstructural development of the sample on which the ECAP processing is performed. Defined by the sequence of orientations of the sample during the ECAP processing, four ECAP routes can be defined as shown in FIG. 4. Namely, routes A, $B_a$, $B_c$, and C. In route A, the sample used in the ECAP processing is not rotated between passes. In route $B_a$, the sample used in the ECAP processing is rotated by 90° in opposite directions between passes. In route $B_c$, the sample used in the ECAP processing is rotated by 90° in the same direction between passes. In route C, the sample used in the ECAP processing is rotated by 180° between passes. In a preferred embodiment, wherein the sample used during the ECAP processing method is a titanium sample, and four passes are performed, route $B_c$ is preferred.

As described earlier, an ultrafine grained bulk titanium structure is obtained by performing the ECAP processing method. Next, a surface of the ultrafine grained structure is obtained by SMAT processing the selected surface. SMAT processing includes placing a sample within a chamber containing spherical balls. The chamber is vibrated using electromechanical means such that the spherical balls move randomly at high speeds striking the sample positioned within the chamber. The striking of the spherical balls, which are generally made of steel, increases a surface hardness of the sample, and modifies a surface roughness and surface wettability. By performing SMAT processing, biomechanical properties, such as fatigue and wear resistance, of the sample positioned within the chamber may be improved.

As seen in FIG. 2, in a preferred embodiment, a system used to perform SMAT processing comprises a chamber 200, a plurality of spherical balls 205, and a vibration generator 207. The chamber 200, which is preferably a vacuum chamber, is used to position the titanium sample having the ultrafine grained structure. When positioning the titanium sample, the surface of the ultrafine grained structure is positioned along a top end 201 of the chamber 200, and the surface is oriented towards a base section 203 of the chamber 200. The plurality of spherical balls 205 is positioned within the chamber 200 in between the surface and the base section 203. Thus, when the vibration generator 207 which is mechanically engaged with the base section 203 of the chamber 200 it vibrates the chamber 200 in a vertical direction, the plurality of spherical balls 205 moves to strike the selected surface.

In a preferred embodiment, the ultrafine grained structure obtained from ECAP processing is sectioned into a plurality of disks using electric discharge machining and a surface portion is selected from a disk from the plurality of disks. Each of the plurality of disks has a diameter within a range of 15 mm-25 mm, with a preferred diameter of about 20 mm. Moreover, each of the plurality of disks has a thickness within a range of 1 mm-4 mm, with a preferred thickness of about 2 mm. To ensure surface uniformity, each of the plurality of disks is grinded with the use of Silicon Carbide (SiC) up to a value within a range of 400 grit-800 grit, with a preferable value of 600 grit.

In a preferred embodiment, the chamber 200 is cylindrical in shape, and is manufactured from stainless steel. A height of the chamber 200 may be within a range of 80 mm-100 mm, preferably 85 mm-95 mm, with a preferable height of about 90 mm. A diameter of the chamber 200 may be within a range of 70 mm-90 mm, preferably 75 mm-85 mm, with a preferable diameter of about 80 mm.

In different embodiments, the type of the plurality of spherical balls 205 can vary. For example, in a preferred embodiment, the plurality of spherical balls 205 is manufactured from Zirconia, wherein zirconia is preferred due to the hardness factor, specific gravity, and the overall composition. More specifically, a Vickers pyramid number of zirconia is 700 HV, a specific gravity value is 3.85 grams/cubic centimeter (g/cm$^3$), and the overall composition preferably includes 60%-70% Zirconium dioxide ($ZrO_2$), 28%-33% Silicon dioxide ($SiO_2$) and Aluminum oxide ($Al_2O_3$) <10% such that the entry of toxic elements into the selected surface upon collision may be prevented.

However, in a different embodiment, the plurality of spherical balls 205 may be manufactured from Alumina. The size of each of the plurality of spherical balls 205 can also have an impact on the nanostructured surface that is developed from the SMAT processing method. Preferably, each of the plurality of spherical balls 205 has a diameter within a range of 4 mm-12 mm, preferably 4 mm-10 mm, with a preferable diameter of about 5 mm. The rate at which the plurality of spherical balls 205 strike the selected surface depends on the vertical motion generated by the vibration generator 207. Preferably, the vibration generator 207 operates at a frequency within a range of 25 Hertz (Hz)-75 Hz, preferably 30 Hz-60 Hz, with a preferred frequency of about 50 Hz. Preferably, the SMAT processing is conducted for approximately 2 hours. In order to prevent overheating of the disk providing the selected surface, the system is turned off for approximately 10 minutes every half an hour.

Terminology used herein is for the purpose of describing particular embodiments only and is not intended to be limiting of the invention.

As used herein, the singular forms "a", "an" and "the" are intended to include the plural forms as well, unless the context clearly indicates otherwise.

As used herein, the term "and/or" includes any and all combinations of one or more of the associated listed items and may be abbreviated as "/".

As used herein in the specification and claims, including as used in the examples and unless otherwise expressly specified, all numbers may be read as if prefaced by the word "substantially", "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), +/−20% of the stated value (or range of values), etc. Any numerical range recited herein is intended to include all subranges subsumed therein.

Disclosure of values and ranges of values for specific parameters (such as temperatures, molecular weights, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10 it also describes subranges for Parameter X including 1-9, 1-8, 1-7, 2-9, 2-8, 2-7, 3-9, 3-8, 3-7, 2-8, 3-7, 4-6, or 7-10, 8-10 or 9-10 as mere examples. A range encompasses its endpoints as well as values inside of an endpoint, for example, the range 0-5 includes 0, >0, 1, 2, 3, 4, <5 and 5.

Spatially relative terms, such as "under", "below", "lower", "over", "upper", "in front of" or "behind" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Obviously, numerous modifications and variations of the present invention are possible in light of the above teachings. It is therefore to be understood that within the scope of the appended claims, the invention may be practiced otherwise than as specifically described herein.

The invention claimed is:

1. A method of producing nanostructured titanium with improved mechanical properties, comprising:

equal-channel angular pressing (ECAP) a titanium tubing at a temperature of 275 to 325° C. to form an ultrafine grained titanium tubing, wherein an average grain size of the ultrafine grained titanium tubing is within a range of 400 nanometers (nm) to 600 nm, then randomly impacting an exposed surface of the ultrafine grained titanium tubing with zirconia shots with a vibration generator at a frequency of 25-75 Hz to subject the exposed surface of the ultrafine grained titanium tubing to a surface mechanical attrition treatment (SMAT) to thereby form a nanostructured region on a portion of the exposed surface of the ultrafine grained titanium tubing, and wherein the nanostructured region extends into the exposed surface of the ultrafine grained titanium tubing to a depth of from 100 micrometers (μm) to 125 μm.

2. The method of claim 1, wherein the ECAPed and SMATed titanium sample improves a cell viability of the titanium sample by 5%-10% in comparison to the titanium sample before the ECAPing and SMATing.

3. The method of claim 1, the ECAPing is carried out on a system comprising:

an ECAP die, wherein the ECAP die is configured to subject the titanium sample to plastic strain without reducing a cross-sectional area of the titanium sample; and a sample-passing channel, wherein the sample-passing channel is integrated into the ECAP die, wherein during the ECAPing the titanium sample is pushed into the sample-passing channel by a plunger at a first end of the sample-passing channel and out through a second end of the sample-passing channel, wherein the second end is configured to be positioned at a channel angle and at a curvature angle to the first end.

4. The method of claim 3, wherein the channel angle is within a range of 80 degrees (°) to 120°.

5. The method of claim 3, wherein the curvature angle is within a range of 15° to 28°.

6. The method of claim 3, wherein a cross-sectional shape of the sample-passing channel and the titanium sample is square.

7. The method of claim 3, wherein a cross-sectional shape of the sample-passing channel and the titanium sample is rectangular.

8. The method of claim 3, wherein the ECAP die is 34CrNiMo6 steel alloy.

9. The method of claim 3, further comprising:

pre-heating the titanium sample before the ECAPing to reduce plunger force.

10. The method of claim 3, wherein the titanium sample is lubricated with graphite during the ECAPing.

11. The method of claim 3, wherein during the ECAPing a punch speed of the plunger is within a range of 1 millimeter/second (mm/s) to 4 mm/s.

12. The method of claim 3, wherein the plunger is H13 tool steel.

13. The method claim 1, wherein a diameter of each of the plurality of spherical balls is within a range of 4 mm-12 mm.

14. The method of claim 1, wherein the vibration generator operates at a frequency within a range of 60 Hertz (Hz) 75 Hz.

* * * * *